US005926200A

United States Patent [19]

Walter

[11] Patent Number: 5,926,200

[45] Date of Patent: Jul. 20, 1999

[54] REUSABLE COLOR DYE CLOSED LOOP DONOR WEB SYSTEM FOR THERMAL PRINTERS

[75] Inventor: Lee Walter, San Diego, Calif.

[73] Assignee: Eastman Kodak Company, Rochester, N.Y.

[21] Appl. No.: 08/942,822

[22] Filed: Oct. 2, 1997

[51] Int. Cl.[6] ..... B41J 2/32; B41J 31/14; B41J 31/16; B41J 31/05

[52] U.S. Cl. ..... 347/217; 347/171

[58] Field of Search ..... 400/197, 198, 400/199, 200, 201, 202, 202.1, 202.2, 202.3, 202.4, 237, 241, 241.1, 241.2; 347/217, 171

[56] References Cited

FOREIGN PATENT DOCUMENTS 62-80062 4/1987 Japan .

*Primary Examiner*—Huan Tran
*Attorney, Agent, or Firm*—William F. Noval

[57] ABSTRACT

A reusable thermal dye donor element for a dye transfer thermal printer comprising: a continuous web support layer having inner and outer surfaces; and a dye donor layer on the outer surface, the dye donor layer formed of a thin film amorphous inorganic or diamond-like carbon (DLC) coating which is hard and wear resistant.

17 Claims, 2 Drawing Sheets

FIG. 1
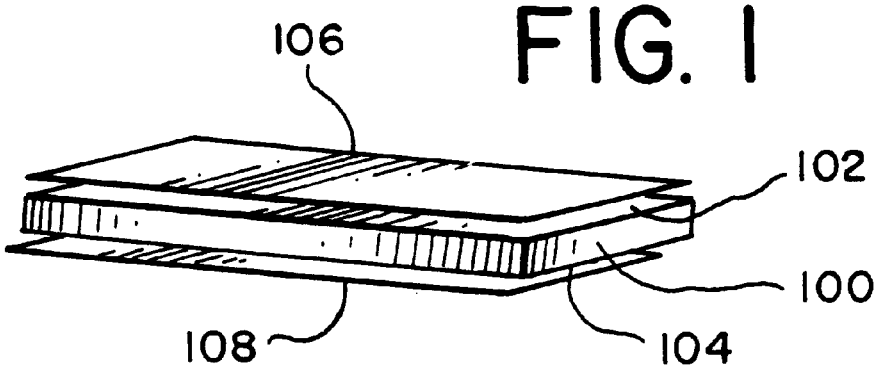
FIG. 2
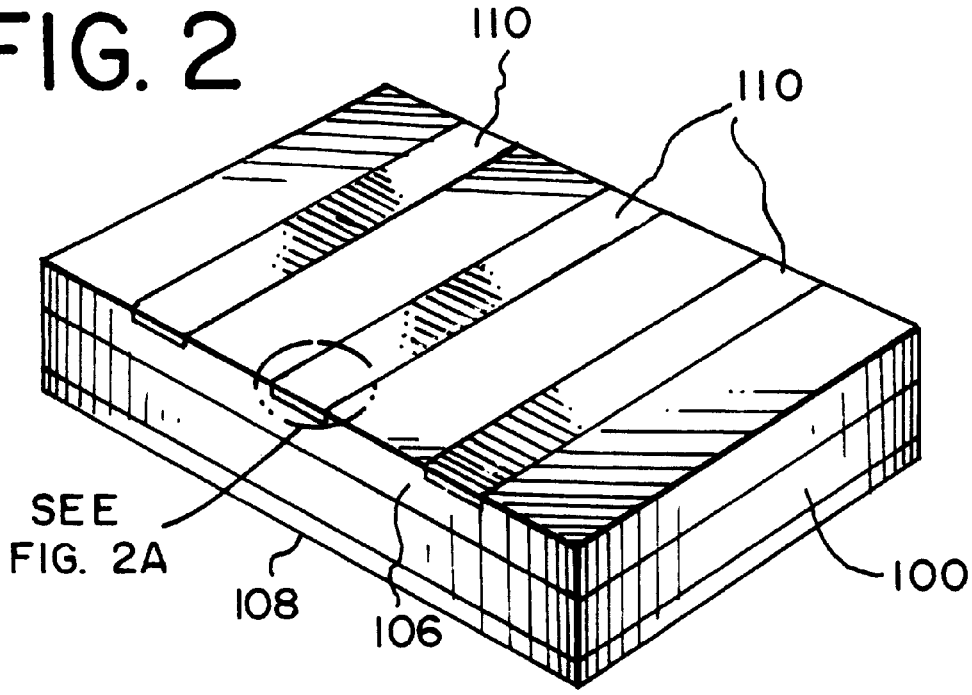
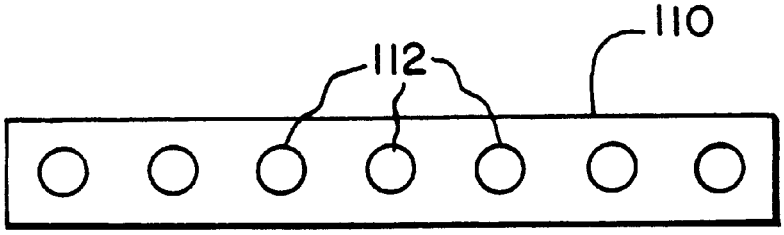
FIG. 2A

FIG. 3
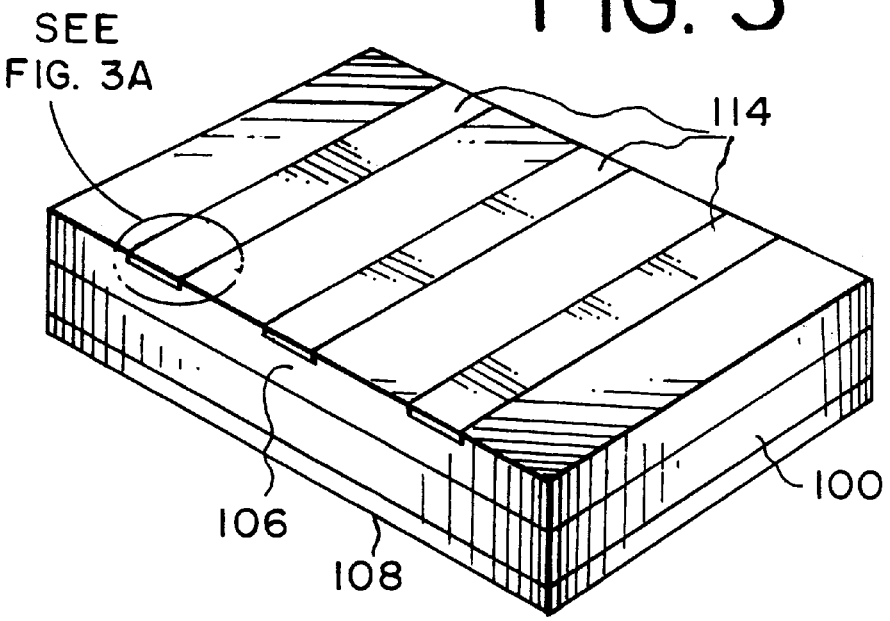
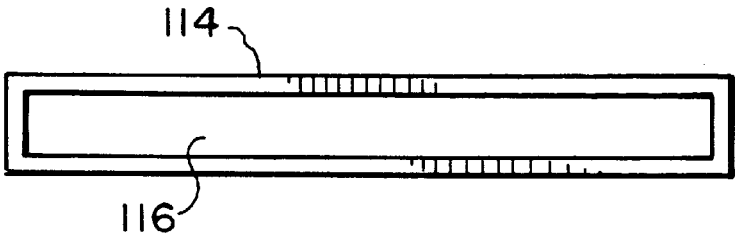
FIG. 3A
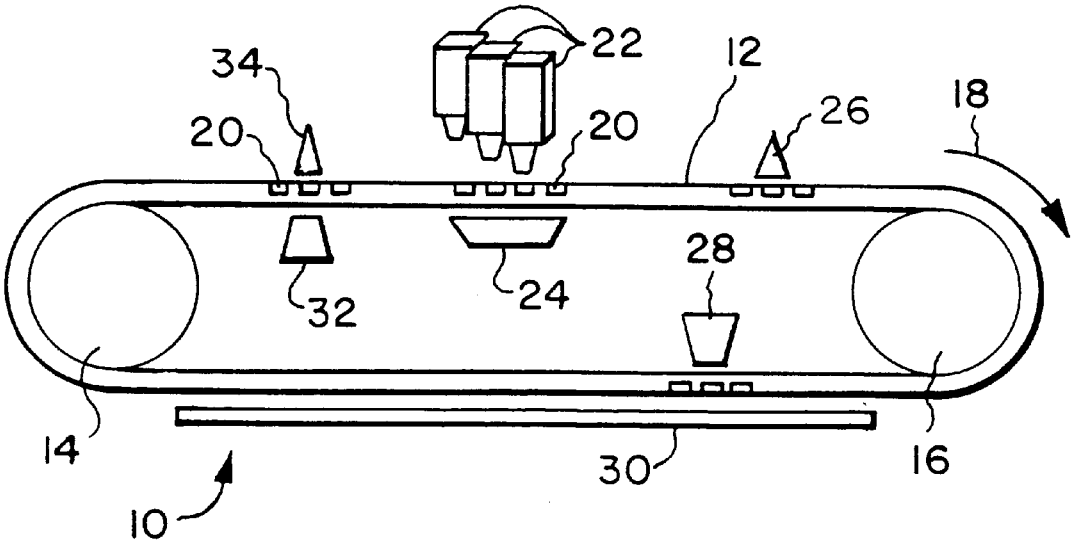
FIG. 4

REUSABLE COLOR DYE CLOSED LOOP DONOR WEB SYSTEM FOR THERMAL PRINTERS

FIELD OF THE INVENTION

This invention relates in general to color dye transfer thermal printers and relates more particularly to a color donor belt for use in such printers that is durable, has long life, is reusable, and is reinkable.

BACKGROUND OF THE INVENTION

Color dye transfer thermal printers use a dye donor in the form of a sheet or a continuous web advanced from a supply roll. Typically, three continuous webs are employed (corresponding to the three fundamental color dyes used) individually or in tandem, to generate the appropriate color and its hue and contrast attributes. The dye donor passes between the dye receiver and a thermal printhead. The printhead consists of a linear array of thermal elements that are selectively energized resulting in an image transfer from the dye donor to the dye receiver.

A significant problem exists in this technology. The transfer mechanism is intended as a single use or a one time event. To print a black image (text or graphics), all three color dye webs are utilized. This results in only a small fraction of each dye being used. After printing, the dye donors cannot be easily reused and are therefore discarded.

The cost of having a single use dye donor web(s) is high because a large surface area of dye donor is required, but only a fraction of the area is utilized to generate the image. Additionally, recycling the used webs can also impact on the cost of such a system.

It has been proposed that a reusable closed looped web (belt) replace the single-use web. The donor dye(s) can then be sublimed in the correct proportions in just the image area. The dye is then transferred to the dye receiver using a thermal print head.

However, even this closed looped system can be problematic. The web material is usually a plastic polymer, such as polyester. The wear and distortions on this belt may limit its life time dramatically. Additionally, continuous control of regeneration of distinguishable color dye transfer to the belt will similarly limit its use and lifetime.

There is thus a need for an improved closed looped dye donor element that can be utilized in thermal printing to provide cost effective continuous thermal dye transfer mechanism with extended life.

SUMMARY OF THE INVENTION

According to the present invention, there is provided a solution to the problems of the prior art According to a feature of the present invention, there is provided a reusable thermal dye donor element for a dye transfer thermal printer comprising: a continuous web support layer having inner and outer surfaces; and a dye donor layer on the outer surface, the dye donor layer formed of a thin film amorphous inorganic or diamond-like carbon (DLC) coating which is hard and wear resistant.

ADVANTAGEOUS EFFECT OF THE INVENTION

The invention provides a viable, durable, and extended life color donor belt that is reusable and reinkable. This belt retains its strength, does not distort under heating cycles, and is wear resistant. These advantages are provided by applying a thin, unique, and protective coating film. The coating also provides advantages in that it can be patterned and the overall printhead structure simplified. The simplification occurs in that the multielement head can therefore be reduced to one or one series of elements by using the patterned belt. Additionally, these advantages make the system low cost and cheaper to upkeep.

BRIEF DESCRIPTION OF THE DRAWINGS

FIGS. 1–3 are diagrammatic perspective views useful in explaining the present invention.

FIG. 4 is a diagrammatic elevational view of a thermal printing system incorporating the present invention.

DETAILED DESCRIPTION OF THE INVENTION

Referring now to FIG. 4, there is shown a color dye transfer thermal printer 10 incorporating the present invention. As shown, printer 10 includes a thermal dye donor belt 12 trained around support drums 14 and 16 for movement in the direction of arrow 18. The upper surface of belt 12 includes a matrix of wells 20 for containing color dyes received from color dye cartridges 22. Three cartridges 22 are provided for cyan, magenta, and yellow dyes. A separate cartridge can be provided for black dye. Transfer of dyes from cartridges 22 to wells 20 of belt 12 can be further aided by thermoelectric cooler 24 on the other side of belt 12. Cooler 24 is a thin film device that can be patterned to further enhance transfer of dye into wells 20.

After dye transfer, the belt 12 is moved under surface cleaning pad 26 to remove any residual dye left on the coated surface to avoid streaks during the print cycle. The active dye area is then moved to a position where thermal print head 28 sublimates the dye from belt 12 to receiver 30. Belt 12 is rotated to another cleaning station where any residual dye is removed from belt 12. This cleaning station includes thermal cleaning head 32 and cleaning pad 34. Belt 12 is then reinked and reused in successive printing cycles. Thermal print head 28 and thermal cleaning head 32 contain an array of discrete resistors to supply heat or electrodes to provide current with heat generation via joule heating.

According to the present invention, as shown in FIG. 1, the dye donor belt 12 includes a continuous web support layer 100 of plastic material (such as polyesters, polyamides, polysulfones, polystyrenes, fluorinated polymers) having outer and inner surfaces 102,104. Outer surface 102 has a dye donor layer 106 formed of a thin film amorphous inorganic or diamond-like carbon (DLC) coating which is hard and wear resistant. Preferably, inner surface 104 has a slip layer 108 formed of a thin film amorphous inorganic or DLC coating which is hard and wear resistant. Slip layer 108 provides increased thermal and physical stability and wear capabilities.

The coatings 106,108 can be of a variety of protective wear resistant inorganic materials, such as inorganic oxides, nitrides, carbides and DLC in thin film form in the range of hundred to several thousand angstrom thick at or close to room temperature (i.e. <<100C.) to avoid distortion and breakdown of the support layer 100. The coatings are preferably applied by a metallo-organic plasma enhanced chemical vapor deposition (MOPECVD) vacuum technique that can process materials at low temperatures in the range of 25 to 100C only with the appropriate choice of organometallic trimethyl aluminum, and trimethyl titanium. The MOPECVD technique is a plasma based process and can be either radio frequency (13.5 Mhz), microwave (2.54 ghz) or optical (hv>5 eV) plasma based. The thin film materials deposited are amorphous analogues of high temperature hard wear coatings commonly deposited on high temperature bearing substrates, such as steels, ceramics, and glasses using high temperature processes (i.e., >250C). These amorphous materials include inorganic nitrides, such as silicon nitride; inorganic oxides, such as silicon dioxide and aluminum oxide; inorganic oxynitrides, such as silicon oxynitrides; inorganic carbides, such as silicon carbide and titanium carbide; inorganic oxycarbides, such as silicon oxycarbides; diamond-like carbon (DLC) and doped variations of DLC, such as DLC doped with silicon nitrogen.

The MOPECVD process can be carried out using a closed chamber having inlet and outlet gas conduits. A dye donor element supported in the closed chamber is subjected to radio frequency energy as primary reactive gases are flowed past.

Secondary reactant gases are introduced to establish the plasma chemistry within the process. Typical secondary reactant gases are molecular hydrogen, molecular nitrogen, molecular oxygen. The RF processing conditions, such as system pressure, forward applied RF power, and inter-electrode spacing are adjusted to optimize the chemistry within the plasma.

For the case of the oxide, carbide and nitride based inorganic coatings of silicon, the optimum organometallic source disilahexane is used in the presence of: a) molecular nitrogen to apply an amorphous film of silicon nitride, b) molecular nitrogen and oxygen to apply an amorphous film of silicon oxynitride, c) molecular oxygen to apply an amorphous film of silicon oxide, d) molecular hydrogen or argon to apply an amorphous film of silicon carbide. Typical processing conditions are as follows: RF power density is equal to or greater than 1.5 Watts/cm$^2$, system pressure in the range of 75 to 1500 mTorr, electrode gap spacing of 2.0 cm, a flow rate of 3 sccm hydrogen, a flow rate of 50 sccm oxygen, a flow of 100 sccm nitrogen, and a flow rate of 60 to 100 sccm argon. Under these conditions, typically 950 to 1000 A of material is deposited per minute.

For amorphous DLC films, methane is typically used in the presence of: a) molecular hydrogen and/or argon to apply an amorphous film of DLC, b) DSH plus molecular hydrogen and/or argon to apply a silicon doped film of DLC, and c) molecular nitrogen to apply a nitrogen doped DLC film. Under these conditions, typically 100 to 500 A per minute is deposited.

As shown in FIGS. 2 and 3, donor layer 106 can be easily patterned using conventional dry or wet etching techniques. This adds additional flexibility and features to the thermal printing system. As shown in FIG. 2, donor layer 106 has a pixel pattern 110 of wells 112 (e.g., 300×300 dpi (dots per inch) or 600×600 dpi). Successive pixel patterns 110 are provided for colors cyan, magenta, yellow (and black).

As shown in FIG. 3, a contiguous active dye strip 114 having a dye reservoir 116 is formed in dye donor layer 106. Successive strips 114 are provided for colors cyan, magenta, yellow (black).

The invention has been described in detail with particular reference to certain preferred embodiments thereof, but it will be understood that variations and modifications can be effected within the spirit and scope of the invention.

PARTS LIST 10 printer
12 dye donor belt
14,16 support drums
18 direction arrow
20 matrix of wells
22 dye cartridges
24 thermoelectric cooler
26 surface cleaning pad
28 thermal print head
30 receiver
32 thermal cleaning head
34 cleaning pad
100 web support layer
102 outer surface
104 inner surface
106 dye donor layer
108 slip layer
110 pixel pattern
112 wells
114 dyestrip
116 dye reservoir

What is claimed is:

1. A reusable thermal dye donor element for a dye transfer thermal printer comprising:

a continuous web support layer having inner and outer surfaces; and a dye donor layer on said outer surface, said dye donor layer formed of a thin film amorphous inorganic or diamond-like carbon (DLC) coating which is hard and wear resistant.

2. The dye donor element of claim 1 including a slip layer on said inner surface, said slip layer formed of a thin film amorphous inorganic or DLC coating which is hard and wear resistant.

3. The dye donor element of claim 1 wherein said amorphous inorganic or DLC coating includes one or more of the following: inorganic nitrides, including silicon nitride; inorganic oxides, including silicon dioxide and aluminum oxide; inorganic oxynitrides, including silicon oxynitrides; inorganic carbides, including silicon carbide and titanium carbide; inorganic oxycarbides, including silicon oxycarbides; DLC and doped variations of DLC, including DLC doped with silicon and nitrogen.

4. The dye donor element of claim 1 wherein said amorphous inorganic or DLC coating is applied by a method comprising the steps of:

flowing a reactive gas past said support layer supported within a chamber, said gas including one or more components for forming an inorganic or DLC coating on said media; and applying a plasma producing energy to said reactive gas, at or near room temperature, to cause an amorphous inorganic or DLC thin film protective coating to be formed on said media by chemical vapor deposition.

5. The dye donor element of claim 4 wherein said plasma producing energy is one of radio frequency energy, microwave energy, or laser energy.

6. The dye donor element of claim 4 wherein said reactive gas includes disilahexane and nitrogen gases and said protective coating formed is silicon nitride.

7. The dye donor element of claim 4 wherein said reactive gas includes disilahexane and nitrogen and oxygen gases and said protective coating formed is silicon oxynitride.

8. The dye donor element of claim 4 wherein said reactive gas includes disilahexane and oxygen gases and said protective coating formed is silicon oxide.

9. The dye donor element of claim 4 wherein said reactive gas includes disilahexane and hydrogen or argon gases and said protective coating formed is silicon carbide.

10. The dye donor element of claim 4 wherein said reactive gas includes methane and hydrogen and/or argon and said protective coating formed is amorphous diamond-like carbon.

11. The dye donor element of claim 4 wherein said reactive gas includes methane and disilahexane and hydrogen and/or argon and said protective coating formed is silicon doped diamond-like carbon.

12. The dye donor element of claim 4 wherein said reactive gas includes methane and nitrogen and said protective coating formed is nitrogen doped diamond-like carbon.

13. A thermal printing apparatus comprising:

a reusable dye donor element including a continuous support layer having a dye donor layer having transferable dye; wherein said dye donor element includes a slip layer formed of a thin film amorphous inorganic or diamond-like carbon (DLC) coating; and a dye transfer station at which dye is transferred from a source of dye to said dye donor layer; said station including a thin film thermoelectric cooler opposite said source of dye and adjacent to said support layer for assisting in dye transfer to said dye donor layer.

14. The apparatus of claim 13 including a cleaning print head with cleaning pads to keep said dye donor element clean of debris and residual dyes.

15. The apparatus of claim 14 wherein said cleaning print head is a single or multi-element thermal print head.

16. The apparatus of claim 13 wherein said dye donor layer has an etched pattern to store transferable dye and wherein said source of dye includes dye reservoir means for transferring dye from said reservoir means to said dye donor layer, and wherein said thermoelectric cooler provides enhanced dye transfer capabilities.

17. The apparatus of claim 13 including a thermal print head which constitutes a single, single series or multielement thermal printhead.

* * * * *